US006062558A

United States Patent [19]

Takahashi

[11] Patent Number: 6,062,558

[45] **Date of Patent: *May 16, 2000**

[54] PAPER FEEDER IN PRINTER

[75] Inventor: Hiroshi Takahashi, Iwate-Ken, Japan

[73] Assignee: Alps Electric Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/089,993

[22] Filed: Jun. 3, 1998

[30] Foreign Application Priority Data

Jun. 3, 1997 [JP] Japan ..... 9-145422

[51] Int. Cl.[7] ..... B65H 3/52; B65H 1/06; B65H 1/24

[52] U.S. Cl. ..... 271/123; 271/165; 271/166

[58] Field of Search ..... 271/35, 109, 121, 271/123, 165, 166

[56] References Cited

U.S. PATENT DOCUMENTS 615,502 12/1898 Shade .
4,021,032 5/1977 Gross et al. ..... 271/166
5,116,034 5/1992 Trask et al. ..... 271/2 X

FOREIGN PATENT DOCUMENTS 58-51857 11/1983 Japan .

*Primary Examiner*—Christopher P. Ellis
*Assistant Examiner*—Kenneth W. Bower
*Attorney, Agent, or Firm*—Brinks Hofer Gilson & Lione

[57] ABSTRACT

A paper feeder in a printer comprises a bottom recording paper guide, an extreme end recording paper guide, a roller, and a mechanism for transferring paper. The bottom recording paper guide is inclined in the paper feeding direction at an angle in the range of ten degrees to thirty degrees.

1 Claim, 1 Drawing Sheet

FIGURE
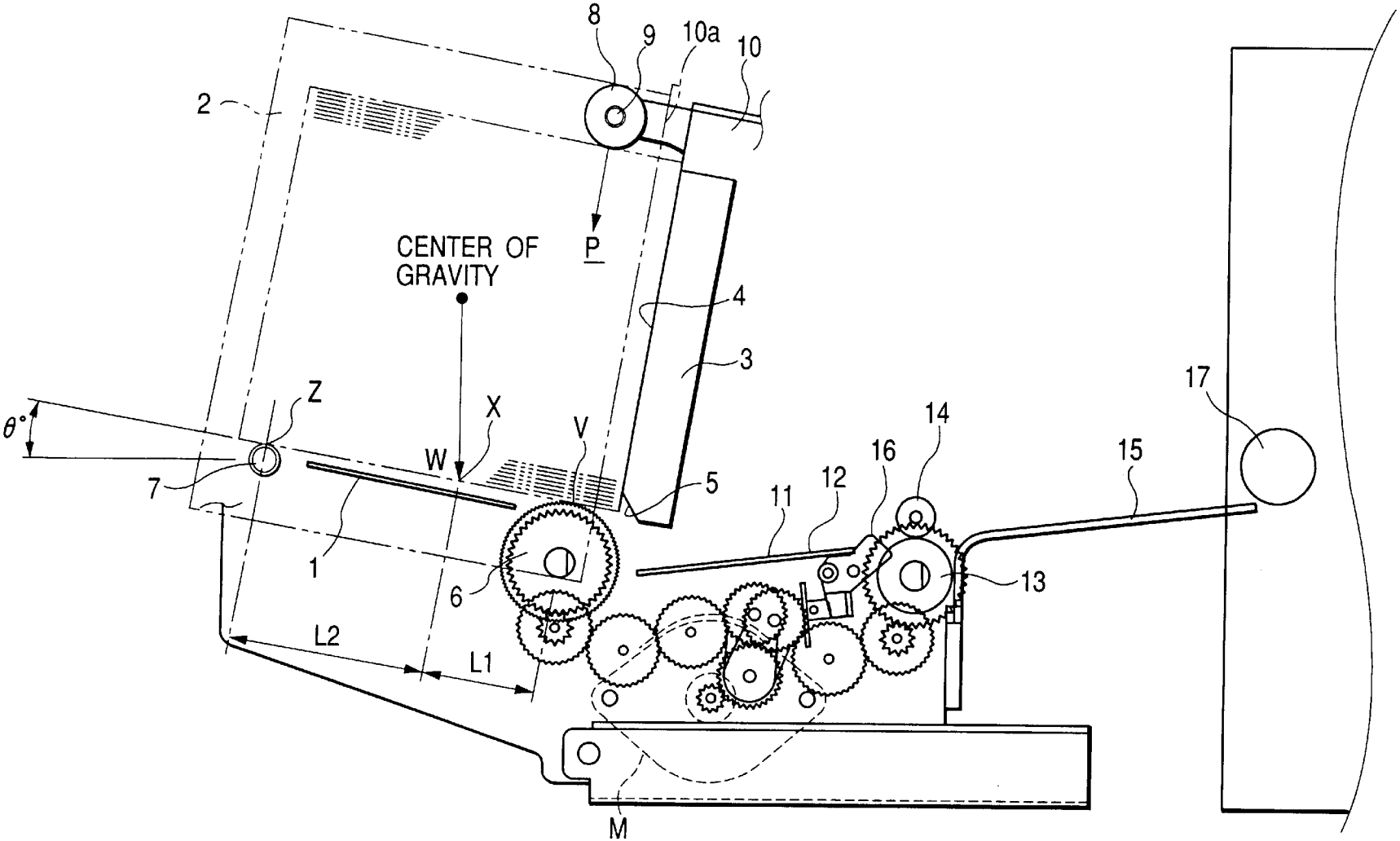

PAPER FEEDER IN PRINTER

BACKGROUND OF THE INVENTION

1. Field of the Invention

The present invention relates to a paper feeder for feeding recording paper automatically in a printer and more particularly to a paper feeder in a printer for separating a plurality of stacked sheets of recording paper one by one and feeding the thus-separated sheets for printing.

2. Description of the Prior Art

Generally, as output devices of computers, word processors and facsimile devices there are used various printers such as thermal printers and page printers.

For performing a desired printing in such printers, plural sheets of recording paper P are stored in a stacked state in storage means which disposed in the body of the printer, then a feed roller is abutted from below against the recording paper P and is rotated, whereby the stacked sheets of recording paper in the storage means are separated and conveyed one by one successively from the sheet located at the lowest position. The recording paper is fed by the feed roller toward a conveyance roller disposed on the front of a printing position of the printer. When the head of the recording paper in the paper feed direction reaches the conveyance roller, the conveyance of the recording paper is taken over by the conveyance roller, which in turn conveys the paper to the printing position.

The storage means in the above conventional printer has a bottom paper guide constituted by a metallic plate which can rest thereon several hundred sheets of recording paper in a stacked state. On a downstream side of the bottom paper guide in the paper feed direction is disposed a feed roller so that the top of the outer peripheral surface of the feed roller is substantially flush with the upper surface of the bottom paper guide to bring the outer peripheral surface into abutment with the recording paper P located at the lowest position. Thus, the feed roller is abutted against the bottom recording paper out of the stacked sheets of recording paper on the bottom paper guide and is then rotated in the paper feed direction to separate only the bottom paper from the paper located just above the bottom paper.

In the conventional paper feeder, the storage means usually stores plural sheets of recording paper in a stacked and substantially horizontal state.

In the conventional paper feeder constructed as above, the upper surface of the bottom recording paper to be fed alone is brought into close contact with the underside of the recording paper located just thereabove and bears a weight load of the stacked sheets of recording paper located thereabove. Therefore, the frictional force acting between adjacent sheets of recording paper may surpass the frictional force between the feed roller and the bottom paper, depending on the rotational force of the feed roller for the separation and conveyance of recording paper, which may result in a failure to effect separation and conveyance of the bottom paper. Thus, such a so-called non-feed error, as well as a so-called double-feed error involving the feed of both bottom paper and the paper located thereabove have heretofore been apt to occur.

Recently, moreover, recording paper for an overhead projector and a surface-coated recording paper has often been used as the aforesaid recording paper P. However, between adjacent sheets of such recording paper there easily occurs a static electricity and the coefficient of friction becomes large, thus easily causing the foregoing non-feed and double-feed errors.

SUMMARY OF THE INVENTION

It is an object of the present invention to provide a paper feeder in a printer capable of stably effecting both separation and feed of recording paper by a feed roller.

It is another object of the present invention to provide a paper feeder in a printer capable of separating only the bottom recording paper from other sheets of recording paper and feeding it properly.

It is a further object of the present invention to provide a paper feeder in a printer capable of eliminating factors which impede the feed of recording paper such as a weight load of other stacked sheets of recording paper imposed on the bottom paper to be fed and the friction between the bottom paper and the paper stacked just thereabove and thereby capable of separating only the bottom paper from the other stacked sheets and feeding it properly.

BRIEF DESCRIPTION OF THE DRAWINGS

FIG. 1 is a schematic side view of a paper feeder in a printer according to an embodiment of the present invention.

DESCRIPTION OF THE PREFERRED EMBODIMENT

The present invention will be described hereinunder with reference to the embodiment thereof illustrated in FIG. 1 and which is used in a so-called card printer for printing on recording paper of the card size such as a card paper.

The paper feeder in a printer according to this embodiment comprises storage means capable of storing plural sheets of recording paper P in a stacked state and feed means for feeding the recording paper P one by one from the storage means to a recording section of the printer. The storage means has a bottom paper guide 1, a side paper guide 2 and a front-end paper guide 3 which are for guiding the recording paper P in a paper feed direction (rightward in FIG. 1) while supporting the paper.

The bottom paper guide 1 is constituted by a metallic plate and functions to guide the bottom recording paper P in the paper feed direction while supporting it from below. In this embodiment, for ensuring a stable feed of recording paper, the bottom paper guide 1 is disposed so that its downstream side is positioned lower than its upstream side in the paper feed direction; that is, the guide 1 is inclined in the paper feed direction. As to the angle of this inclination and the effect thereof, reference will be made later.

The side paper guide 2 comprises two plates opposed to each other through a predetermined spacing in the width direction of the bottom paper guide 1 and extending upward perpendicularly to the upper surface of the bottom paper guide 1. The side paper guide 2 guides the recording paper P in the paper feed direction while supporting both transverse sides of the recording paper P.

The front-end paper guide 3 has a paper abutting surface 4 for abutment with the front ends of the plural sheets of recording paper P stacked on the bottom paper guide 1 and it is disposed on the downstream side of the bottom paper guide 1 in such a manner that its paper abutting surface 4 extends upward perpendicularly to the upper surface of the bottom paper guide 1. The lower end portion of the paper abutting surface 4 is formed as a slant surface which faces downward to the upstream side in the paper feed direction. The slant surface serves as a paper separating surface 5 for separating the stacked sheets of recording paper P one by one. The lower the position, the more advanced is the recording paper in the paper feed direction along the paper separating surface 5. In feeding the recording paper, the stacked sheets of recording paper are sure to be separated and fed one by one successively from lower positions while being guided by the paper separating surface 5.

On the downstream side of the bottom paper guide 1 in the paper feed direction and in the portion thereof opposed to the paper separating surface 5 of the front-end paper guide 3 there is disposed a feed roller 6 in such a manner that the top of its outer peripheral surface is projected from the upper surface of the bottom paper guide 1 by a height corresponding to the thickness of at least one sheet of recording paper P and extends in the direction crossing the paper feed direction at right angle. The feed roller 6 is supported so that it can be rotated in the paper feed direction by drive means such as, for example, a stepping motor M.

Further, near the rear end portion of the bottom paper guide 1 is disposed a rear end supporting roller 7 as a support member in such a manner that the top of its outer peripheral surface is projected from the upper surface of the bottom paper guide 1 by a height corresponding to the thickness of at least one sheet of recording paper P and extends in the transverse direction. The rear end supporting roller 7 is supported so as to rotate following the conveyance of the recording paper P which is in abutment with the rear end supporting roller. When the bottom recording paper P, out of the stacked sheets of recording paper on the bottom paper guide 1, is fed, the rear end portions of the second and subsequent sheets of recording paper from the bottom are supported by the roller 7 to diminish the load imposed from above on the bottom recording paper P. Consequently, the frictional force between the bottom recording paper P and the second recording paper P placed thereon, as well as the frictional force between the bottom paper and the bottom paper guide 1, are diminished and hence not only each recording paper can be fed easily but also it is possible to prevent the double-feed error. The shape of the rear end supporting roller 7 is not specially limited insofar as it can keep the rear end portions of the stacked sheets of recording paper P spaced away from the bottom paper guide 1. However, a roller shape such as the rear end supporting roller 7 permits the friction to be further diminished when the bottom paper P is fed, and hence it is possible to prevent a roller trace from being left on the paper P.

It is desirable that the height of the feed roller 6 and that of the rear end supporting roller 7 projecting from the upper surface of the bottom paper guide 1 be made equal to each other. However, both rollers may be disposed so that the projection of the roller 7 is to a somewhat larger extent than that of the roller 6. This is because the center of gravity of the stacked sheets of recording paper P supported by both rollers 6 and 7 is applied to the roller 6 side to which the paper feeding drive force is transmitted. From this theory it follows that it is not desirable for the center of gravity of the stacked sheets of recording paper P to be biased to the rear end supporting roller 7 side.

A pressing roller 8 is journaled rotatably above the bottom paper guide 1, which roller presses the stacked sheets of recording paper P from above by utilizing the own weight of the roller. Since the pressing roller 8 functions as a weight, it is formed of a metallic material having a desired specific gravity such as brass for example. A load is imposed by the pressing roller 8 on the front end side of each recording paper P in the transverse direction of the paper upper surface. A support shaft 9 of the pressing roller 8 is supported by generally L-shaped support arms 10*a* at positions near both end portions thereof. The support arms 10*a* are supported to be movable vertically by roller support guides 10 which are disposed in the vertical direction of the front-end paper guide 3. According to this arrangement, when the quantity of the stacked paper sheets decreases, the pressing roller 8, by virtue of its own weight, moves downward while being guided by the roller support guide 10, allowing the recording paper P to be always present between the pressing roller 8 and the feed roller 6 located below the pressing roller. The pressing roller 8 comes into pressure contact with the upper surface of the top recording paper P to press the stacked paper sheets from above. Therefore, even when only the last sheet of recording paper P is left on the bottom paper guide, the last paper can be pressed against the feed roller 6, thus preventing the occurrence of a paper feed error.

As noted previously, the storage means is inclined downward in the paper feed direction as a whole. By such an inclined arrangement it is intended to apply the center of gravity of the recording paper P to the downstream side in the paper feed direction for the purpose of smoothing the paper feeding operation, thereby bringing the feed roller disposed on the downstream side and the bottom paper into pressure contact with each other to generate a frictional force between the lower surface of the bottom paper and the feed roller 6 which frictional force is larger than the frictional force between the upper surface of the bottom paper and the paper located just thereon. By so doing, it becomes possible for only the bottom paper to be surely separated and fed from the paper P located just thereon.

Reference will be made below to the foregoing inclination angle, θ°.

As to the inclination angle θ° of the storage means (the bottom paper guide 1), it is absolutely necessary in view of various experimental results that a virtual perpendicular dropped vertically downward from the center of gravity of the stacked sheets of recording paper P on the upper surface of the bottom paper guide should not go beyond, in the paper feed direction, a tangent line between the feed roller 6 and the recording paper which is in contact with the feed roller. If the inclination angle θ° is large and the condition just mentioned is not satisfied, the center of gravity will be imposed too much on the paper front-end side, resulting in plural sheets of recording paper being fed at a time. That is, the double-feed error is apt to occur.

In connection with the inclination angle θ°, as shown in FIG. 1, the distance from an intersecting point X between a virtual perpendicular extending vertically downward from the center of gravity of the stacked sheets of recording paper P on the bottom paper guide 1 and the bottom of recording paper P to an intersecting point Y between a virtual line passing through the center of the feed roller 6 and perpendicularly intersecting the bottom of recording paper P and the bottom of recording paper P is assumed to be L1. Further, the distance from the intersecting point X to an intersecting point Z between a virtual line passing through the center of the rear end supporting roller 7 and perpendicularly intersecting the bottom of recording paper P and the bottom of recording paper P is assumed to be L2. It is most desirable to set the inclination angle at a value at which the distance L1 is zero.

According to an experimental result here referred to for explanation of a more concrete inclination angle, when about 300 sheets of card paper formed in the size of 95 mm long by 55 mm wide were placed to a height of about 70 mm on the bottom paper guide 1 in such a manner that their longitudinal direction lay in the paper feed direction, it was when the inclination angle θ° was set at 30° that the aforesaid distance L1 became zero.

Even when it is impossible for the storage means to have an inclination angle of 30° due to a limitation on the height or size of the paper feeder, the feed of recording paper can be done to a satisfactory extent by setting the inclination angle θ° at 10° to 30°. This has been made clear from experimental results.

By thus tilting the storage means as a whole, the distance L1 can surely be made smaller than the distance L2 even in the case where the distances L1 and L2 become equal to each other (L1=L2) when the storage means of the paper feeder is installed horizontally. As a result, it becomes possible to apply the center of gravity of the recording paper P biasedly to the feed roller 6 and hence only the bottom recording paper P can be fed surely at an increased pressure of contact of the paper with the feed roller 6.

Thus, the reason why the storage means is inclined is because it is intended to impose the weight of recording paper P on the feed roller 6 in a larger proportion than on the rear end supporting roller 7, thereby increasing the contact pressure between the feed roller 6 and the recording paper P to afford a larger frictional force.

In this embodiment, therefore, if the degree of inclination of the storage means is expressed in terms of the ratio between a weight load (P1) acting on the feed roller 6 and a weight load (P2) acting on the rear end supporting roller 7, it is inevitably required to satisfy the relation of P1>P2. According to experimental results, when this ratio was set at 4:3, there could be attained an outstanding effect based on an inclination of the storage means. The angle θ° of the inclination was 10.6°.

In order for the feed roller 6 to effect appropriate paper separation and feed, it is required as an essential condition to meet the following relation:

$$P1\times\mu1>(P1+P2)\ \mu2+\text{load on the paper separating portion}$$

where $\mu1$ stands for a friction coefficient of roller and $\mu2$ stands for a friction coefficient between adjacent sheets of recording paper. Thus, the inclination angle θ° is determined so that the weight loads P1 and P2 of recording paper P are distributed to the feed roller 6 and the rear end supporting roller 7 to satisfy the above condition while taking into account the coefficient of friction between adjacent papers, the load on the paper separating portion, etc. The load on the paper separating portion as referred to herein means the load imposed on the paper separating portion by the pressing roller 8 which serves as a weight in abutment with the top recording paper P out of the stacked sheets of recording paper on the storage means.

In this embodiment, the storage means is inclined downward in the paper feed direction as a whole at an inclination angle of 10.6°. On this regard, the following description is now provided with reference to FIG. 1.

On the other hand, the feed means has a construction for feeding the stacked sheets of recording paper P successively one by one from the storage means, starting with the sheet located at the bottom position.

To be more specific, on the downstream side of the bottom paper guide 1 in the paper feed direction, the feed roller 6 is supported rotatably in contact with the underside of recording paper P. Further, on the downstream side (the right-hand side in FIG. 1) of the feed roller 6 in the paper feed direction is disposed a paper guide 12 having a paper sliding surface 11 for sliding the recording paper P. The paper guide 12 guides in the paper feed direction the recording paper P which has been fed from the storage means by the feed roller 6. In the paper feed path downstream the paper guide 12 in the paper feed direction there are disposed a conveyance roller 13 and a driven roller 14 which is in contact with the roller 13 from the outside and is rotated thereby. The recording paper P is conveyed while being sandwiched in between the conveyance roller 13 and the driven roller 14. In the paper feed path is further disposed a conveyance guide 15 downstream the conveyance roller 13 in the paper feed direction. The conveyance guide 15 causes the recording paper P to slide and guides it toward the recording section of the printer.

At a position before the conveyance roller 13 and the driven roller 14 is disposed a paper sensor 16 to detect that the recording paper P has passed a predetermined position. In this embodiment, by means of a spring (not shown), the paper sensor 16 is urged upward and is projected slightly from the paper guide 12. When the recording paper P passes above the paper sensor 16, the paper sensor moves downward against the biasing force of the spring to detect the passage of the paper.

The construction of the paper sensor 16 is not limited to the one just described above. For example, there may be used an optical sensor which detects the passage of recording paper P on the basis of the reflecting speed of light.

The recording paper P is fed in the paper feed direction by virtue of a frictional force and in view of this point the feed roller 6 and the conveyance roller 13 are formed of a polymeric material such as rubber so as to enhance the frictional force between them and the recording paper.

The recording paper P then passes a feed roller 17 disposed in the printer further downstream of the conveyance guide 15 in the paper feed direction and is fed to the recording section in the printer for use in a desired printing.

In this embodiment, the feed roller 6 and the conveyance roller 13 are constructed so as to be rotated by a single stepping motor M as drive means through power transfer gears for paper feed and power transfer gears for conveyance, respectively. A detailed explanation of this point is here omitted. The surface of the card paper used as recording paper is coated with a plastic material for the purpose of strengthening the paper and preventing the paper from being stained.

The following description is now provided about the operation of the paper feeder of this embodiment using the card paper as recording paper P.

Prior to starting the paper feed operation, plural sheets of recording paper P are stacked on the storage means. In this embodiment, about 300 sheets of the card paper are stacked in such a manner that the lower surface portion of the bottom paper on the front side in the paper feed direction and the lower surface portion of the bottom paper on the rear side in the paper feed direction are brought into contact with the feed roller 6 and the rear end supporting roller 7, respectively, whose tops are projected from the upper surface of the bottom paper guide 1. The recording paper P having a plastic coating has a very high stiffness and is carried on both feed roller 6 and rear end supporting roller 7 while the central portion thereof in the paper feed direction is spaced from the bottom paper guide 1. In this embodiment, the storage means (the bottom paper guide 1) is inclined at an angle of 30° in the paper feed direction. This inclination angle θ° has been calculated to distribute the weight P of recording paper to both feed roller 6 and rear end supporting roller 7 so as to satisfy the foregoing condition of "$P1\times\mu1>(P1+P2)\ \mu2+$load on the paper separating portion," taking into account, for example, the friction coefficient $\mu1$ of the feed roller 6 in the paper feeder, the friction coefficient $\mu 2$ generated between adjacent sheets of card paper, and the weight load of the pressing roller 8. As to the storage means inclined downward in the paper feed direction at an angle of 30°, the distance L1 from the intersecting point X between a virtual perpendicular dropped from the center of gravity of the stacked sheets of recording paper P on the storage means and the bottom of recording paper P to the intersecting point Y between a virtual line passing through the center of the feed roller 6 and perpendicularly intersecting the bottom of recording paper P and the bottom of recording paper is zero. This means that the center of gravity of the stacked sheets of recording paper P on the bottom paper guide 1 is positioned on the point of contact with the feed roller 6 to increase the contact pressure of the bottom paper against the feed roller 6.

In the paper feeder of this embodiment, between the central portion of recording paper P in the paper feed direction and the upper surface of the bottom paper guide 1 is formed a gap of a size at least corresponding to the projecting distance of the feed roller 6 and the rear end supporting roller 7.

In this state, the operation for feeding the recording paper P is started in accordance with a command provided from printer control means (not shown). With a command issued from the control means, the stepping motor M rotates and this driving force is transmitted to the feed roller 6 via the foregoing drive gears, resulting in that the feed roller rotates clockwise (in the recording paper feed direction) in FIG. 1. With this rotation of the feed roller 6, the bottom paper out of the stacked sheets of recording paper P on the bottom paper guide 1 is separated from the recording paper located thereabove and starts moving in the paper feed direction.

In this case, the front end portion of the bottom recording paper P is separated from the other stacked sheets of recording paper by the paper separating surface 5 formed at the lower end portion of the front-end paper guide 3 and then the bottom paper moves in the paper feed direction while being guided by both bottom paper guide 1 and side paper guide 2.

At this time, since the storage means is inclined in the paper feed direction, the frictional force induced between the bottom paper and the feed roller 6 surpasses the frictional force between the bottom paper and the paper located on the upper surface of the bottom paper. Consequently, only the bottom paper can be fed surely.

When the rear end portion of the bottom paper P is moved out of contact with the rear end supporting roller 7 which rotates following the movement of the bottom paper, it comes to be positioned in the gap formed on the bottom paper guide 1 and assumes a free condition within the gap. In other words, the frictional force or static electricity developed between the bottom recording paper P and the recording paper P just thereon and acting on the bottom recording paper decreases and the weight load of the above stacked sheets of recording paper on the bottom paper is also diminished.

On the other hand, the rear end supporting roller 7 comes into abutment with the underside of the second sheet of recording paper P from the bottom and supports the second and subsequent sheets of recording paper P stacked on the storage means.

In this state, with a further rotation of the feed roller 6, the recording paper P, whose rear end portion has left the roller 7, moves along the bottom paper guide 1 in the paper feed direction, passes the feed roller 6, and is thereafter fed toward the conveyance roller 13 while being guided by the paper guide 12.

That is, the rotational force of the feed roller 6 acts on only the bottom recording paper P, whereby the bottom paper is separated from the recording paper located just on the bottom paper, while the stacked sheets of recording paper except the bottom paper stay on the bottom paper guide 1 by virtue of both frictional force exerted between adjacent sheets of recording paper and the own weight of the stacked sheets.

After the rear end portion of the bottom paper has passed the feed roller 6, the feed roller comes into abutment with the underside of the front end portion of the next sheet of recording paper P and inevitably comes to support the second from the bottom and subsequent sheets of recording paper.

When the paper sensor 16 located before the conveyance roller 13 detects the recording paper P being conveyed, this passage information is transmitted to the foregoing control means, which in turn makes control to rotate the conveyance roller 13 in the paper feed direction. Thereafter, the recording paper P is sandwiched in between the conveyance roller 13 and the driven roller 14 which is rotated with the rotation of the conveyance roller 13, and moves toward the recording section in the printer while being guided by the conveyance guide 15 disposed behind the conveyance roller 13, then is fed to the recording section via the feed roller 17.

In this way the feed and conveyance of one sheet of recording paper P is completed. If the next sheet of recording paper P is to be fed in a continuous manner, a series of paper feed and conveyance operations described above are repeated in accordance with the control made by the foregoing control means.

In this embodiment, since the pressing roller 8 presses the stacked sheets of recording paper P from above by virtue of its own weight, even if the number of stacked sheets of recording paper decreases to the last one paper, this last paper can be pressed positively against the feed roller 6 to generate a frictional force strong enough to feed the last paper.

Thus, according to the paper feeder in a printer of this embodiment, in order to make the feed of recording paper P more smooth, the center of gravity of the stacked sheets of recording paper P on the upper surface of the bottom paper guide 1 is applied to the downstream side in the paper feed direction to the extent that a virtual perpendicular extending vertically downward from the center of gravity does not go beyond a tangent line between the feed roller 6 and the recording paper in the paper feed direction, whereby the feed roller 6 located on the downstream side in the paper feed direction and the bottom recording paper are brought into pressure contact with each other. As a result, a frictional force larger than the frictional force between the bottom paper and the paper located just thereon, exerted on the upper surface of the bottom paper, can be created between the lower surface of the bottom paper and the feed roller 6. It follows that only the bottom paper can be surely separated and fed from the paper located just thereon. Therefore, it is possible to prevent the occurrence of such feed errors as double feed and non-feed.

Particularly, in the case of the plastic-coated recording paper P used in this embodiment, static electricity is apt to be developed between adjacent stacked sheets of recording paper and hence the coefficient of friction generated between adjacent sheets also becomes high. In the paper feeder of this embodiment, however, the inclination angle θ° of the storage means is calculated taking such a printing environment into account, so in a contacted state of the underside of the bottom paper with the feed roller, the frictional force between the bottom paper and the feed roller can be made larger than the frictional force exerted between adjacent sheets of recording paper. Consequently, only the bottom paper can be surely separated and fed from the paper located just thereon.

The present invention is not limited to the above embodiment, but various modifications may be made as necessary.

For example, the recording paper may be ordinary paper, paper for an overhead projector, post card paper, or cardboard. Further, the inclination angle θ° is not limited to 10.6° adopted in the above embodiment. Any other inclination angle may be adopted insofar as a virtual perpendicular extending vertically downward from the center of gravity of the stacked sheets of recording paper on the upper surface of the bottom paper guide does not go beyond a tangent line between the feed roller and the recording paper in the paper feed direction.

According to the paper feeder of the present invention, as set forth hereinabove, the contact pressure of recording paper against the feed roller is increased to prevent the occurrence of feed errors, whereby the stacked sheets of recording paper can be surely fed one by one successively from the bottom paper.

What is claimed is:

1. A paper feeder in a printer comprising:

a bottom recording paper guide, the bottom recording paper guide having a flat upper surface, the bottom recording paper guide for guiding a plurality of stacked sheets of recording paper and inclining them downward in a paper feed direction while supporting the plurality of stacked sheets from below by the flat upper surface;

an extreme end recording paper guide, the extreme end recording paper guide disposed at a downstream side of said bottom recording paper guide in the paper feed direction, the extreme end recording paper guide having a recording paper abutment surface to which an extreme end of said plurality of stacked sheets of recording paper is abutted, the recording paper abutment surface having a lower part, the lower part comprising a surface, slanted with respect to the extreme end paper guide in the paper feed whereby the lower part acts as a sheet separating surface for individually separating said stacked sheets of recording paper one by one;

a feed roller, the feed roller disposed at a downstream side in the paper feeding direction of said bottom recording paper guide in opposition to and adjacent said sheet separating surface of said extreme end recording paper guide, the feed roller having an outer circumferential surface, the outer circumferential surface having an uppermost part, the uppermost part of the outer circumferential surface projected from said upper surface of said bottom recording paper guide at least by a size more than a thickness of one sheet of said recording paper, the feed roller supporting said recording paper while abutting said recording paper from below against its extreme end in the paper feeding direction, said feed roller feeding paper from a lowest position in sequence of the plurality of stacked sheets of recording paper to a recording section;

a rotatable supporting roller disposed on an upstream side in the paper feeding direction of said bottom recording paper guide to support the rear end part of the recording paper stacked on the bottom paper guide, the rotatable supporting roller having an outer circumferential surface, the rotatable supporting roller having an uppermost part of its outer circumferential surface, the uppermost part of the rotatable supporting roller projected from the upper surface of said bottom recording paper guide such that the uppermost part of the rotatable supporting roller is positioned higher than a line defined by the uppermost point of said bottom recording paper guide and the uppermost point of said feed roller; and means for transferring paper, the means for transferring paper for transferring sheets of recording paper separately fed by said feed roller to the recording section one by one, wherein:

said bottom recording paper guide is inclined, the inclination within an angular range of 60 degrees to 80 degrees, the angle being between a vertical line passing through the center of gravity of the paper sheets stacked on said bottom paper guide on one side of the angle and said upper surface of said bottom paper guide on the other side of the angle, and more of the weight of the stack of recording paper is on said feed roller than on said rotatable supporting roller, thereby increasing the pressure at which said recording paper sheet contacts with said feed roller.

* * * * *

UNITED STATES PATENT AND TRADEMARK OFFICE

CERTIFICATE OF CORRECTION

PATENT NO. : 6,062,558
DATED : May 16, 2000
INVENTOR(S) : Hiroshi Takahashi

It is certified that error appears in the above-identified patent and that said Letters Patent is hereby corrected as shown below:

Title page,
Item [73], change "Ltd., Japan" to -- Ltd., Tokyo, Japan --.

Claim 1,
Line 17, change "guide in the paper feed whereby" to -- guide; whereby --.

Signed and Sealed this

Sixteenth Day of April, 2002

*Attest:*

*Attesting Officer*

JAMES E. ROGAN
*Director of the United States Patent and Trademark Office*